US006517386B2

(12) United States Patent
Sakakura et al.

(10) Patent No.: US 6,517,386 B2
(45) Date of Patent: Feb. 11, 2003

(54) ELECTRICAL CONNECTOR AND METHOD OF MAKING THE SAME

(75) Inventors: Hiroshi Sakakura, Tokyo (JP); Takeshi Sumiyoshi, Tokyo (JP); Kenichi Hirokawa, Tokyo (JP); Takehiro Kameya, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 09/870,459

(22) Filed: Jun. 1, 2001

(65) Prior Publication Data

US 2001/0049233 A1 Dec. 6, 2001

(30) Foreign Application Priority Data

Jun. 5, 2000 (JP) ..... 2000-166900

(51) Int. Cl.[7] ..... H01R 24/00
(52) U.S. Cl. ..... 439/676; 439/79; 439/941
(58) Field of Search ..... 439/676, 941, 439/79, 660

(56) References Cited

U.S. PATENT DOCUMENTS 4,269,467 A * 5/1981 Hughes ..... 339/126

* cited by examiner

*Primary Examiner*—P. Austin Bradley
*Assistant Examiner*—Truc Nguyen
(74) *Attorney, Agent, or Firm*—Kanesaka & Takeuchi

(57) ABSTRACT

A method of making an electrical connector comprises assembling a frame mold (30) having front, rear, and bottom openings, a front mold (40) attached to the frame mold (30) from front and having a channel (43) for receiving the flexible section (21) and a portion of the intermediate section (23) of a terminal corresponding to the flexible section (21), a rear mold (50) attached to the frame mold (30) from rear and having a comb section (52) entering between the intermediate section (23) and the flexible section (21), and a bottom mold (60) attached to the frame mold (30) from below and having an upper support face (62A) for supporting the intermediate section (21) of the terminal.

1 Claim, 9 Drawing Sheets

ELECTRICAL CONNECTOR AND METHOD OF MAKING THE SAME

BACKGROUND OF THE INVENTION

1. Field of the Invention

The present invention relates to an electrical connector and a method of making the same.

2. Description of the Related Art

A connector comprising a rectangular housing having a receiving cavity for receiving a mating plug connector and a plurality of terminals extending obliquely in the receiving cavity for spring contact with terminals of the mating connector is well known. Japanese patent application Kokai No. 7-106010 discloses such a connector as shown in FIG. 9. This connector 100 comprises a rectangular housing 101 having upper and lower openings and closing members 103 and 104 supporting a plurality of terminals 102.

To make the connector 100, the terminals 102 and the closing members 103 and 104 are formed integrally as a unit. Then, the terminals 102 are bent twice, and the closing members 103 and 104 are mounted in the housing 101. More specifically, the substantially straight terminals 102A and the closing members 103 and 104 are molded integrally in a line. Then, the terminal 102A projecting from the closing member 104A is bent in a direction A to form a contact section 105. Then, the terminal 102A is bent between the closing members 103 and 104 at right angles in a direction B. Then, it is mounted in the housing 101. The contact sections 105 extend obliquely in the receiving cavity such that they make spring contact with the terminals of a mating connector that is inserted into the receiving cavity in a direction as shown by an arrow.

The above connector, however, has such disadvantages as separately forming the housing and the closing members, bending twice the terminals after molding, and mounting the closing members in the housing, making the manufacturing process complicated and pushing up the manufacturing cost.

SUMMARY OF THE INVENTION

Accordingly, it is an object of the invention to provide a simple method of making a connector at a low cost and a connector made by such a method.

According to the invention there is provided an electrical connector comprising a substantially rectangular housing having a receiving cavity extending rearwardly from a front end of said housing for receiving a mating plug connector; a plurality of terminals arranged in said housing at regular intervals, each made by bending a metal pin and having an intermediate section with at least one retention portion retained in a wall of said housing that partially defines said receiving cavity, a flexible section diagonally extending from an end of said intermediate section for spring contact with a terminal of said plug connector, said flexible section and a corresponding portion of said intermediate section lying in a single plane, and a connection section extending from the other end of said intermediate section and projecting from said housing, wherein said terminal is molded integrally with said housing at said retention section. According to the invention, the housing is molded integrally with the terminal at the retention section.

It is preferred that the intermediate section is bent at right angles to form a bend across which there are provided said retention portions that are retained by upper and rear walls of said housing. The intermediate section may have a straight portion that is forward from said bend or said bend may be shifted laterally by a terminal arranging interval.

According to another aspect of the invention there is provided a method of making such an electrical connector, comprising the steps of assembling a frame mold having front, rear, and lower openings, a front mold attached to said frame mold from front and having on its top at least one channel for receiving said flexible section and a portion of said intermediate section opposed to said flexible section, a rear mold attached to said frame mold from rear and a comb section with at least one tooth entering between said intermediate and flexible sections of said terminal for contact them, and a bottom mold attached to said frame mold from below to form a metal mold; pouring a resin into said metal mold to mold said housing so as to retain said retention section of said terminal; and removing said respective molds to provide said electrical connector.

The method may further comprise the step of providing said comb section with a rear upper face that is equal to or higher than a lower face of said band and a front upper face that makes contact with a lower face of said intermediate section. The method may further comprise the steps of providing said comb section with an upper face of a rear portion that is equal to or higher than a lower face of said band and a front upper face that makes contact with a lower face of said intermediate section; shifting laterally said rear portion by a half of said terminal arranging interval; and moving laterally said metal mold by said half terminal arranging interval after said metal mold is inserted.

According to still another aspect of the invention there is provided a method of making such an electrical connector, comprising the steps of assembling (a) a frame mold having front, rear, and lower openings, (b) a front mold attached to said frame mold from front and having on its top at least one channel for receiving said flexible section and a portion of said intermediate section opposed to said flexible section, (c) a rear mold attached to said frame mold from rear and having at least one channel to support said intermediate section of said terminal, and (d) a bottom mold attached to said frame mold from below and having an upper face to support said intermediate section of said terminal to form a metal mold; pouring a resin into said metal mold to mold said housing so as to retain said retention section of said terminal; and removing said respective molds to provide said electrical connector.

The method may further comprises the step of providing said frame mold with a support mold having a retaining channel to retain said intermediate section of said terminal.

DESCRIPTION OF THE PREFERRED EMBODIMENT

Embodiments of the invention will now be described by way of example with respect to the accompanying drawings.

First Embodiment

Figure 1:
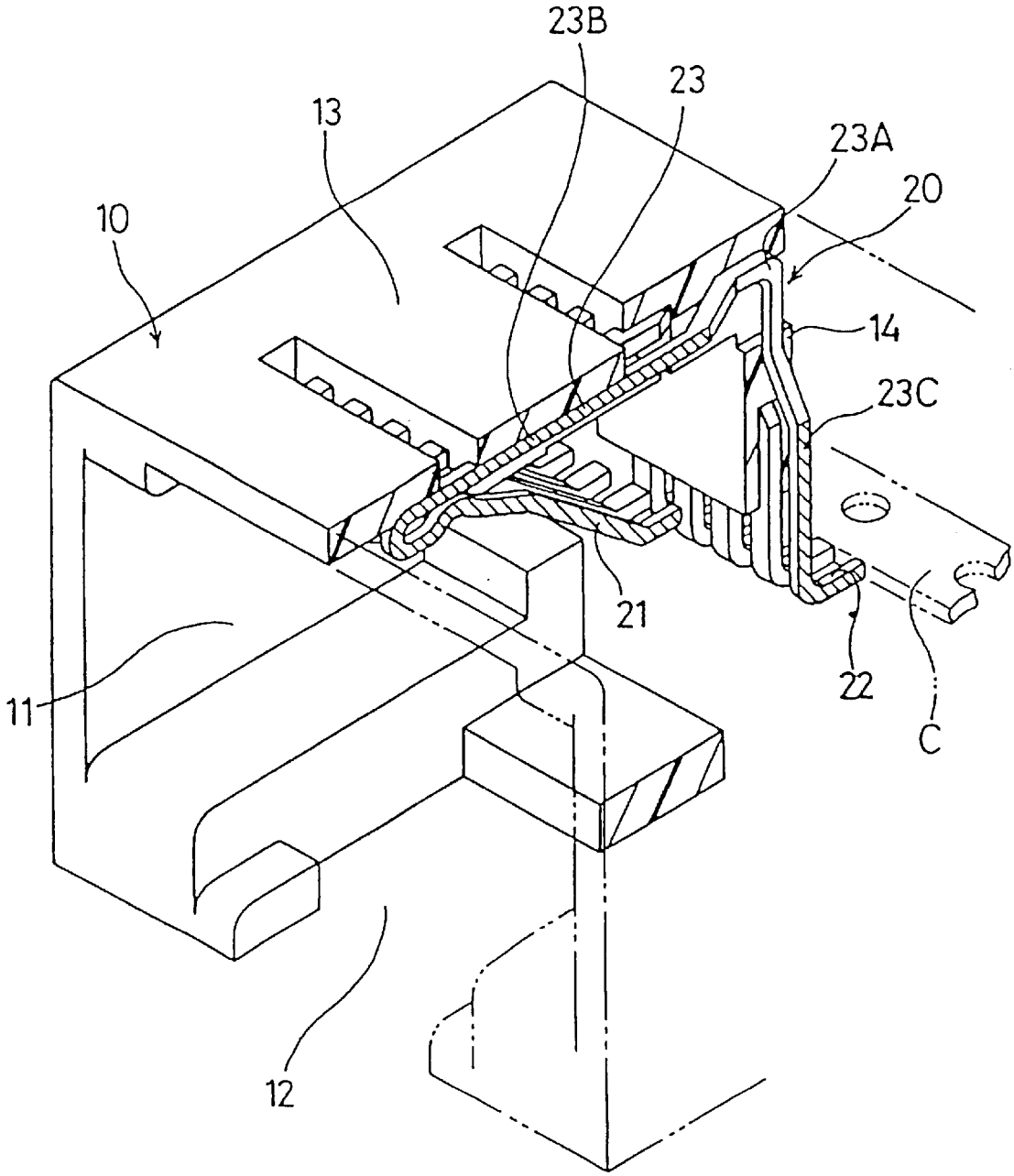
FIG. 1 is a perspective view, partially in section, of an electrical connector according to an embodiment of the invention.

In FIG. 1, a connector has a rectangular housing 10 that is molded from an insulative material such as a resin. A receiving cavity 11 extends rearwardly from the front end of the housing 10 to receive a mating plug connector. A cut-out 12 is provided in the bottom of the housing 10 to receive the lock releasing arm of the plug connector. The housing 10 has a rear wall with a portion thereof cut out, and upper and side walls. A plurality of terminals 20 are supported by the housing 10. That is, the terminals 20 are molded together with the upper and rear walls 13 and 14 of the housing 10.

The terminals 20 are made by stamping a plurality of pins extending from a carrier strip, bending the pins in a predetermined shape, molding integrally with the housing in a metal mold, and cutting off the carrier strip. Each terminal 20 has a flexible section 21 at an end, a connection section 22 at the other end, and an intermediate section 23 between them. The intermediate section 23 has an L-shaped bend 23A in its middle and retention portions 23B and 23C that are supported by the upper and rear walls 13 and 14 of the housing 10. The flexible section 21 extends obliquely rearwardly, making an acute angle with the retention portion 23B in the upper wall 13. The free end of the flexible section 21 makes spring contact with a terminal of the plug connector that is inserted into the receiving cavity 11.

Figure 2:
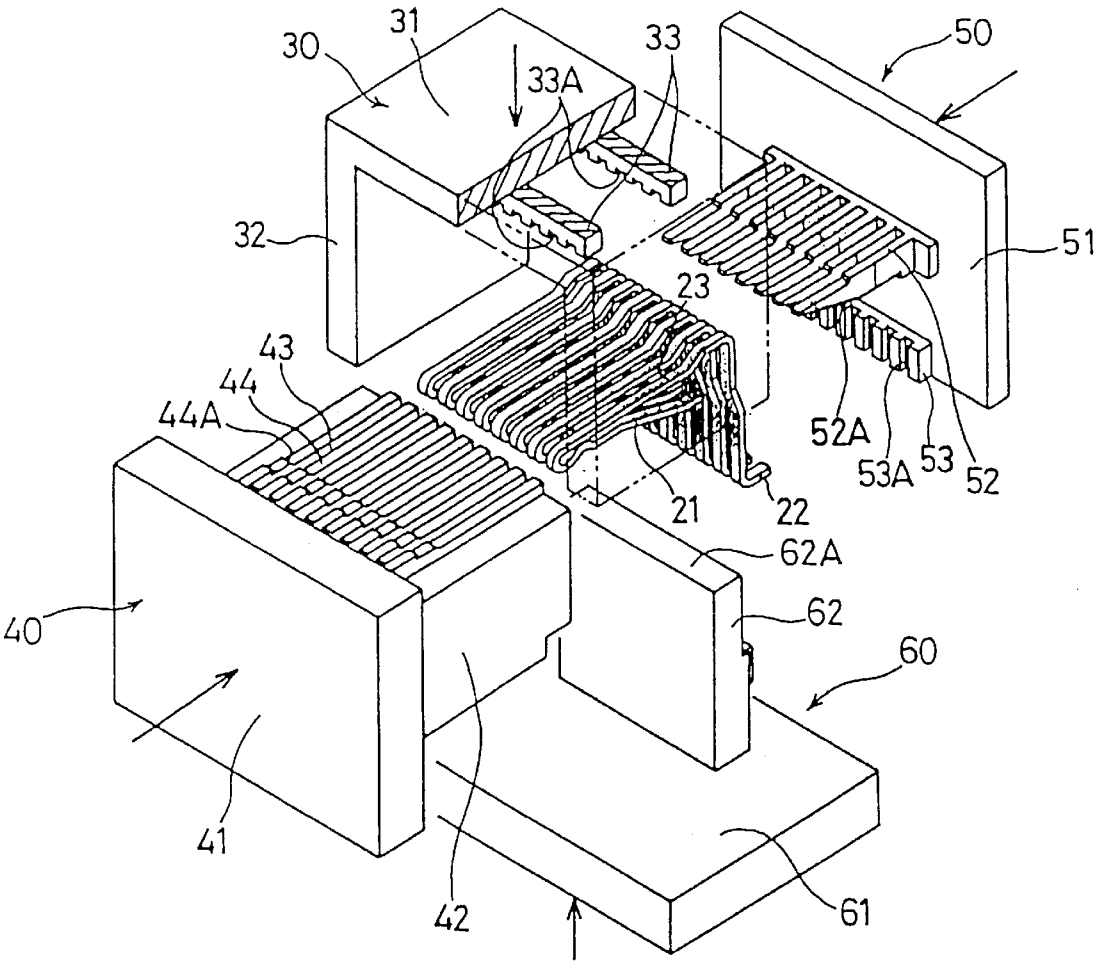
FIG. 2 is an exploded, perspective view of various molds for making an integral molding of the electrical connector of FIG. 1.

The L-shaped bend 23A is offset laterally by one terminal arranging interval such that it is aligned with the intermediate section 23 of the adjacent terminal 23. The connection section 22 has a horizontal end, which is placed on and soldered to the electrical circuit of a circuit board. The terminals 20 are molded integrally with the housing 10 and supported at the retention portions 23B and 23C. In FIG. 2, the molding is made by means of various molds.

A metal mold is composed of a frame mold 30, a front mold 40, a rear mold 50, and a bottom mold 60. These four molds are assembled to define a closed cavity for molding a housing.

The frame mold 30 has an upper plate 31 and opposite side plates 32 with the inner faces opposed to the outer faces of the upper and side walls 13 and 14 of the housing 10. A support mold 33 with a plurality of support channels 33A is provided on the inner face of the upper plate 31 to support the retention portions 23B of terminals 20 at predetermined positions.

The front mold 40 has a plate section 41 to close the front face of the frame mold 30 and a block section 42 that enters into the frame mold 30. A plurality of channels 43 are provided in the upper face of the block section 42 to receive the retention portions 23A of intermediate sections 23 and the flexible section 21. The depth of each channel 43 is set at such a value that the channel 43 can receive both the retention portion 23A and the flexible section 21, with the flexible section 21 flexed toward the retention portion 23B. The upper face of each ridge 44 is lowered at a shoulder 44A so that the lower face of the retention portion 23B is slightly higher than the lowered upper face of the ridge 44. Consequently, the retention portion 23B of each terminal 20 is supported firmly by the housing on its upper face and part of the side faces.

The rear mold 50 has a plate section 51 to cover the rear face of the frame mold 30, a comb section 52 extending forwardly from the plate section 51, and a support section 53 provided on the lower part of the plate section 51. Each tooth of the comb section 52 has a width equal to a gap between the terminals and a lower face 52A tapered toward the front end thereof. It is inserted into a space between the intermediate section 23 and the flexible section 21. The support section 53 has a plurality of channels 53A to support the retention portions 23C above the connection sections 22.

The bottom mold 61 has a plate section 61 to close the bottom face of the frame mold 30 and a support wall 62 erected on the plate section 61. When the support wall 62 is inserted into the frame mold 30, the upper face 62A abuts on the horizontal portion of the bends 23 of terminals 20 for support.

How to make the connector will be described below.

(1) First of all, a metal sheet is stamped to provide a row of pins extending from an edge of a carrier strip.

(2) Then, the pins are bent to provide a set of terminals 20 (connected to the carrier strip C) as shown in FIG. 1.

Figure 3:
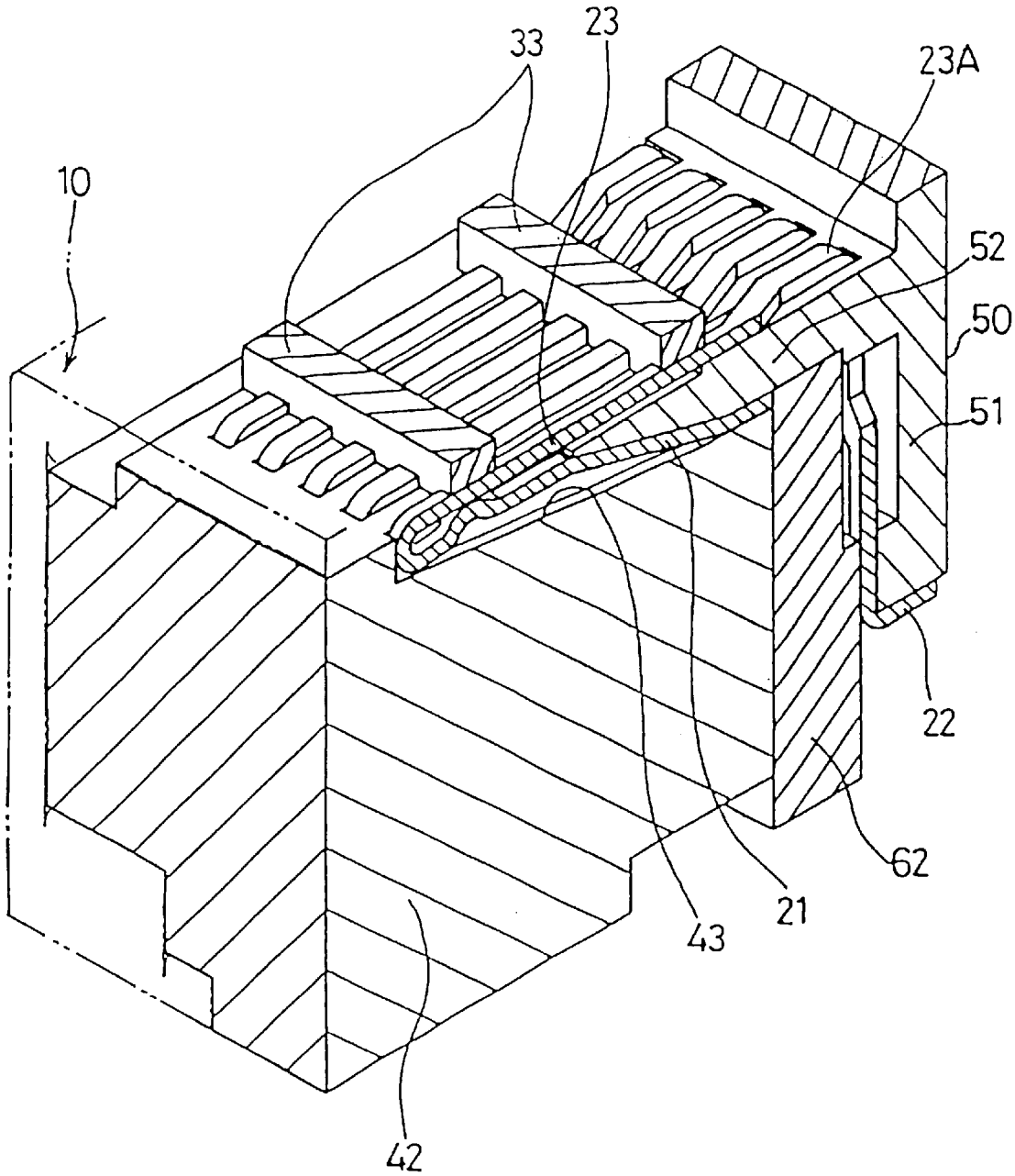
FIG. 3 is a perspective sectional view of the molds assembled with terminals.

(3) Then, the terminal set is supported by the four molds; i.e., the frame mold 30, the front mold 40, the rear mold 50, and bottom mold 60 (FIG. 3). Then, a resin is put into the cavity defined by these molds to provide a molded connector in which the terminals are supported by the housing at the retention portions 23B and 23C as shown in FIG. 1.

(4) Finally, all the molds 30, 40, 50, and 60 are removed and the carrier strip C is cut off at the ends of the connection sections 22.

Second Embodiment

Figure 4:
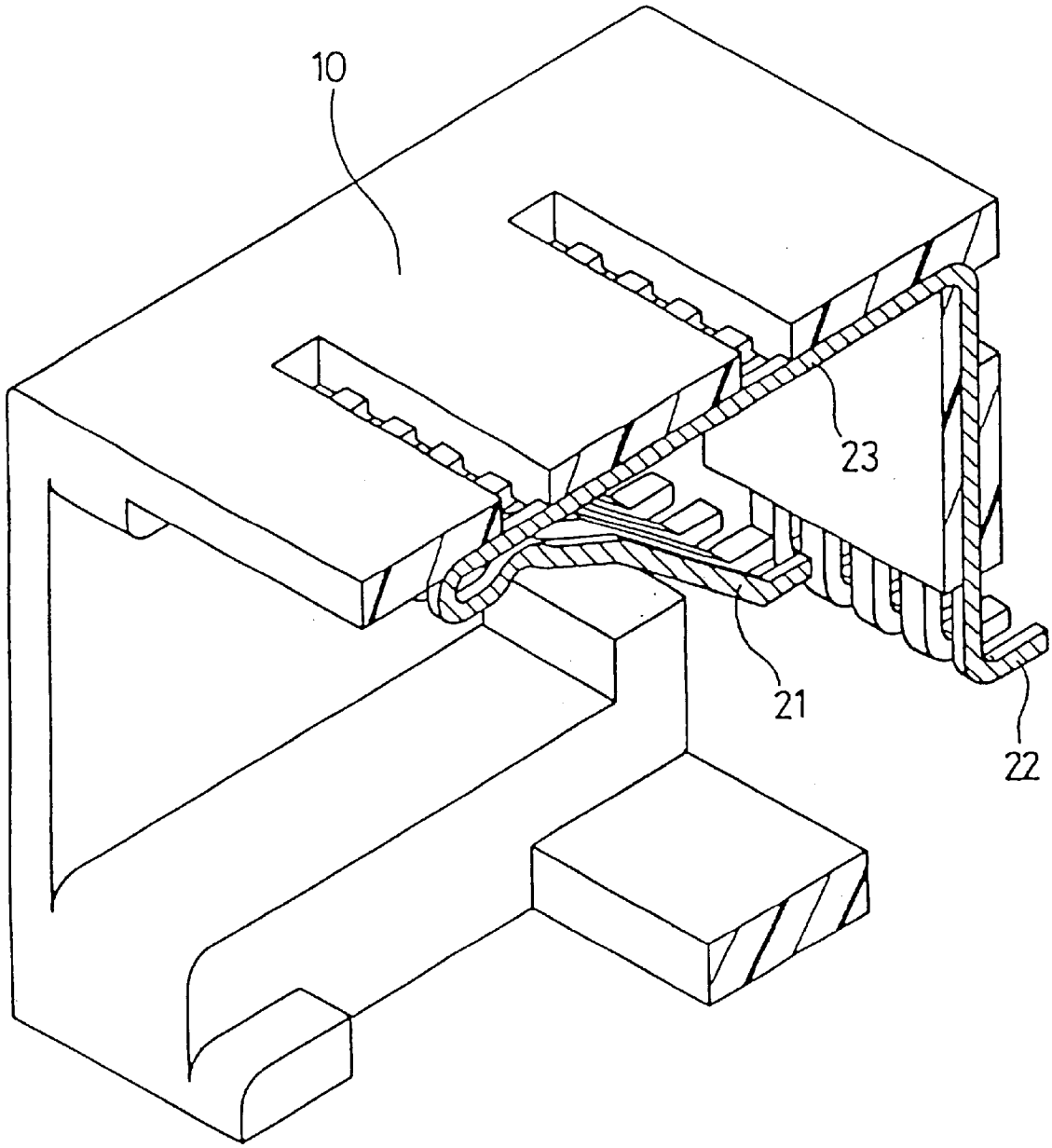
FIG. 4 is a perspective view, partially in section, of an electrical connector according to another embodiment of the invention.

In FIG. 4, this connector is the same as the FIG. 1 embodiment except that the flexible section 21, the connection section 22, and the intermediate section 23 lie in a single flat plane. In this figure, the wall or cover section of each mold is omitted.

Figure 5:
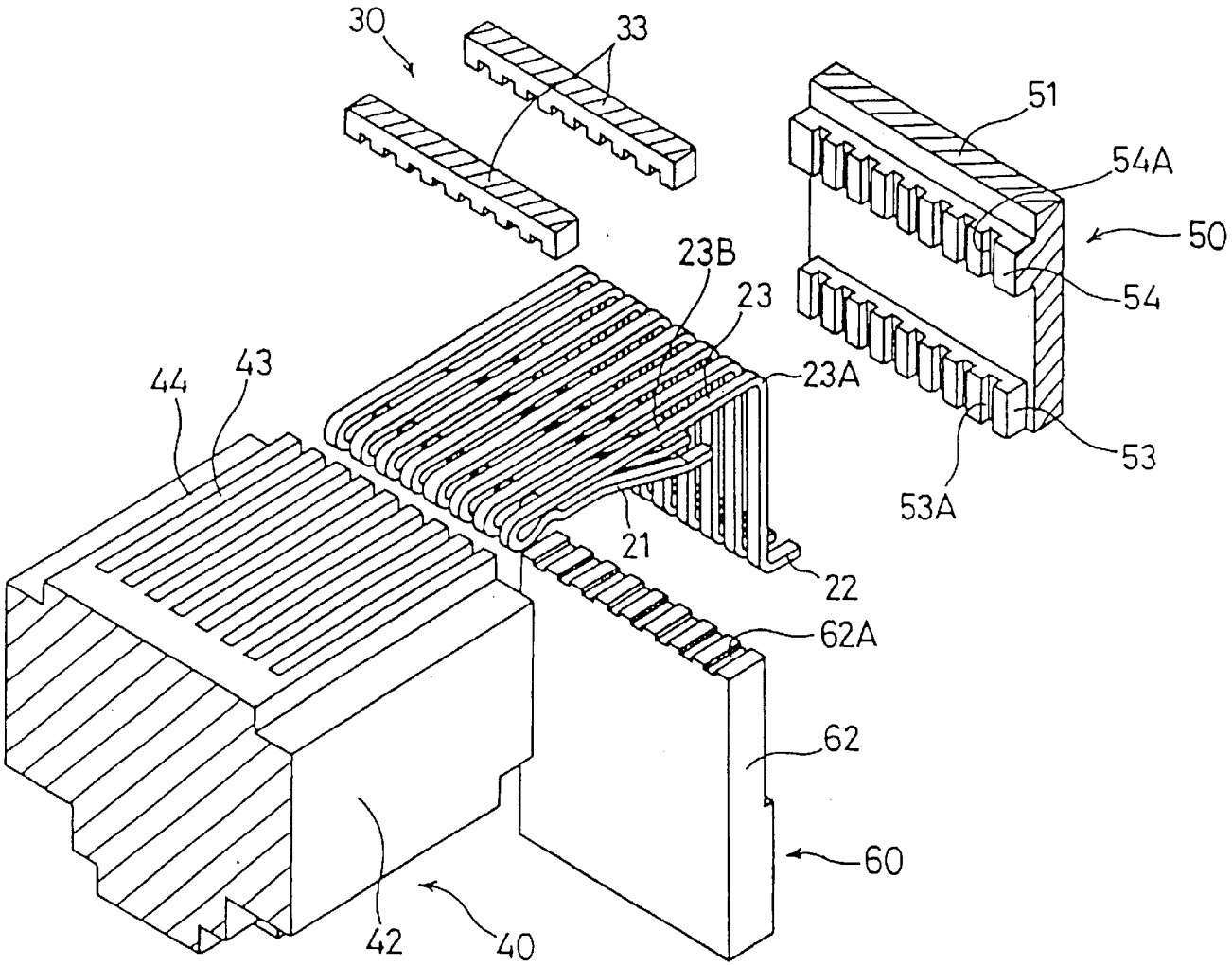
FIG. 5 is an exploded, perspective view of various molds for integral molding of the electrical connector of FIG. 4.

The respective molds for making this connector are changed from the FIG. 2 molds to those such as shown in FIG. 5.

(a) The rear mold 50 does not have any comb-like section but a support section 54 that is the same as support section 53. Consequently, the vertical portions of terminals 20 below the L-shaped bends 23 are supported in two channels 53A and 54A of the support sections 53 and 54.

(b) The upper faces of respective ridges 44 on the front mold 40 lie in a single flat plane. The retention portions 23B of the terminals project slightly from the flat plane.

(c) A plurality of channels 62B are provided in the upper face of the support wall 62 to support the intermediate sections 23 of terminals.

Figure 6:
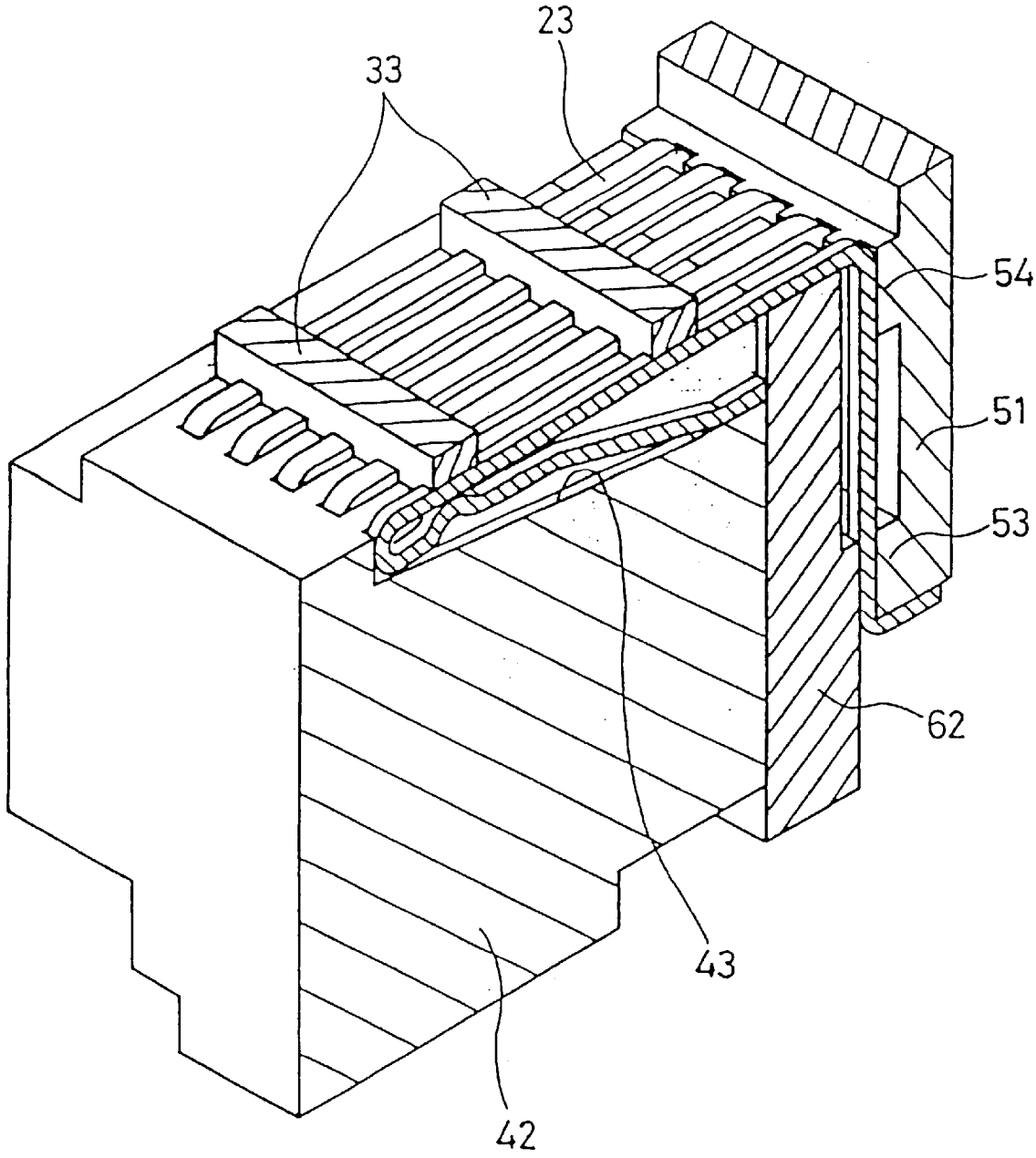
FIG. 6 is a perspective, sectional view of the molds of FIG. 5 assembled with terminals.

Similarly to molding of the FIG. 1 connector, these molds are used to make integral molding of the housing and terminals (FIG. 6). In this embodiment, the respective molds surround the flexible sections and the corresponding intermediate sections.

Third Embodiment

According to the third embodiment, the FIG. 4 connector is made by a metal mold that is different from the FIG. 5 mold.

Figure 7:
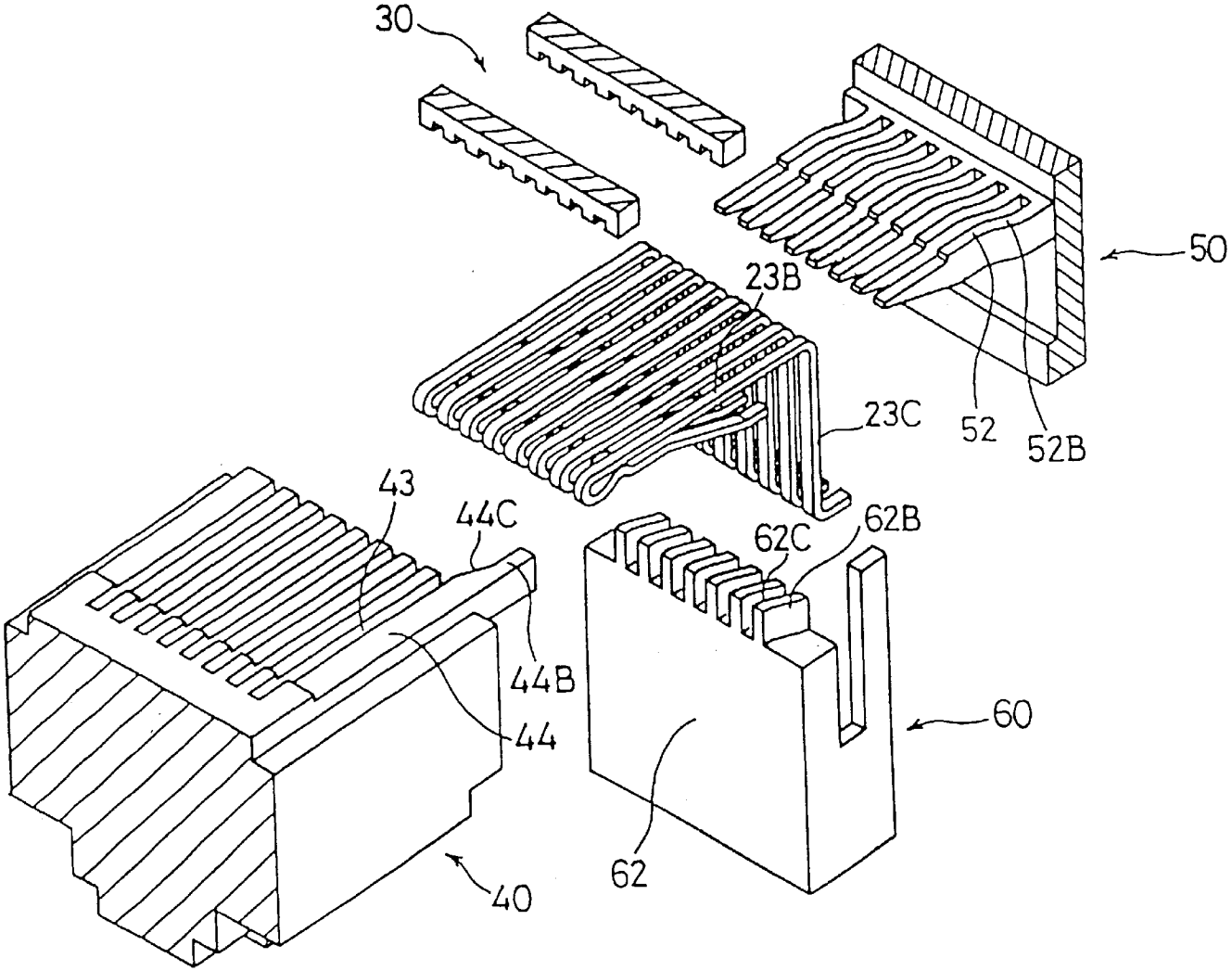
FIG. 7 is an exploded, perspective view of various molds for integral molding of the electrical connector of FIG. 4 according to still another embodiment of the invention.

In FIG. 7, the rear mold 50 is different from that of FIG. 5 and, according to this difference, the front and bottom molds 40 and 60 are also different. The rear mold 50 is similar to that of FIG. 2 except that the comb section 52 is offset by a half of the terminal arranging interval at the base position 52B. After it is inserted into the metal mold, the comb section 52 is moved by the offset distance in the arranging direction after the base position 52B passed the vertical retention portion 23C so that the front portions of the comb section 52 from the base position 52B are placed under the retention portions 23B at positions similar to those of FIG. 1.

Figure 8:
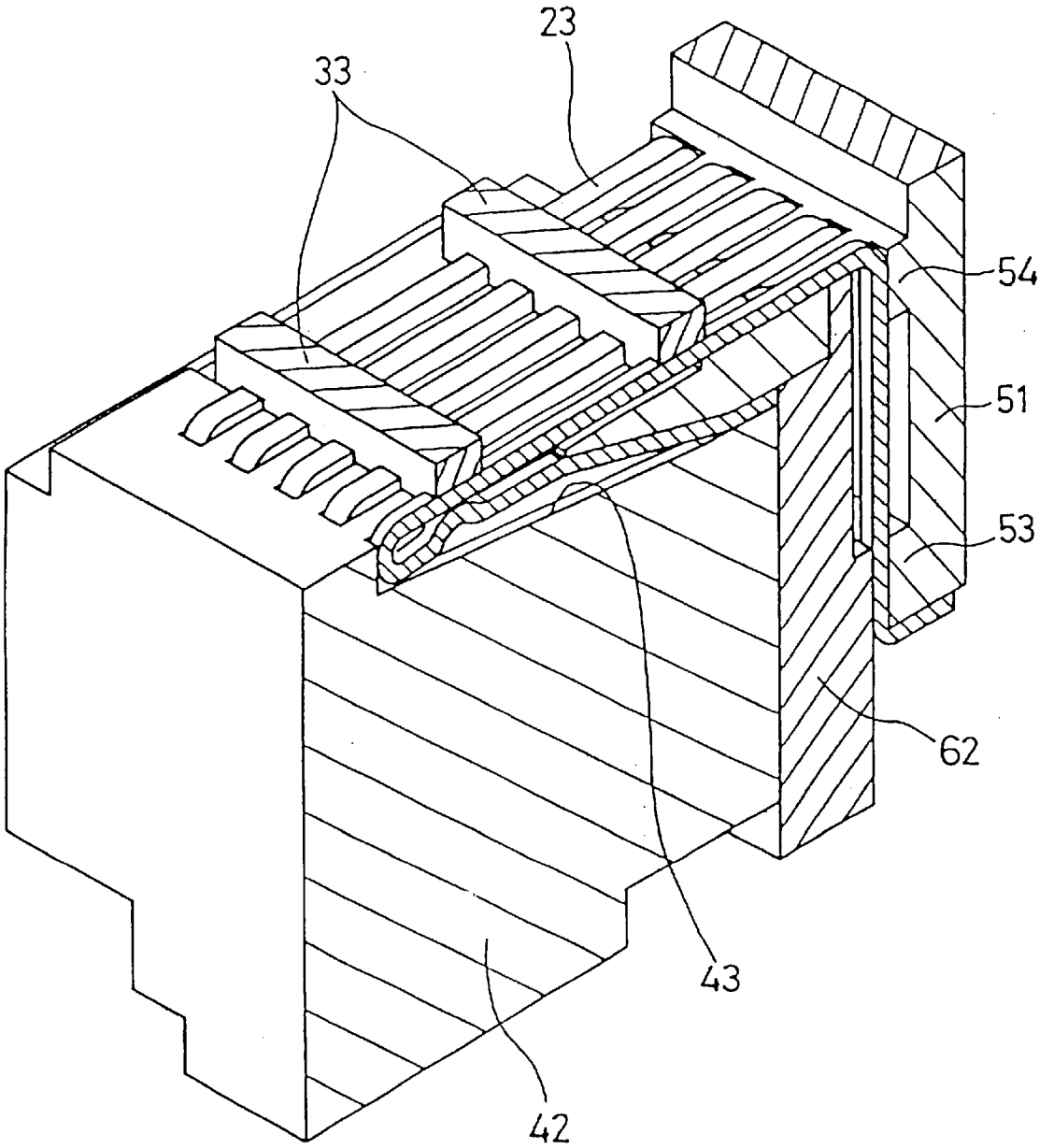
FIG. 8 is a perspective, sectional view of the molds assembled with terminals.
Figure 9:
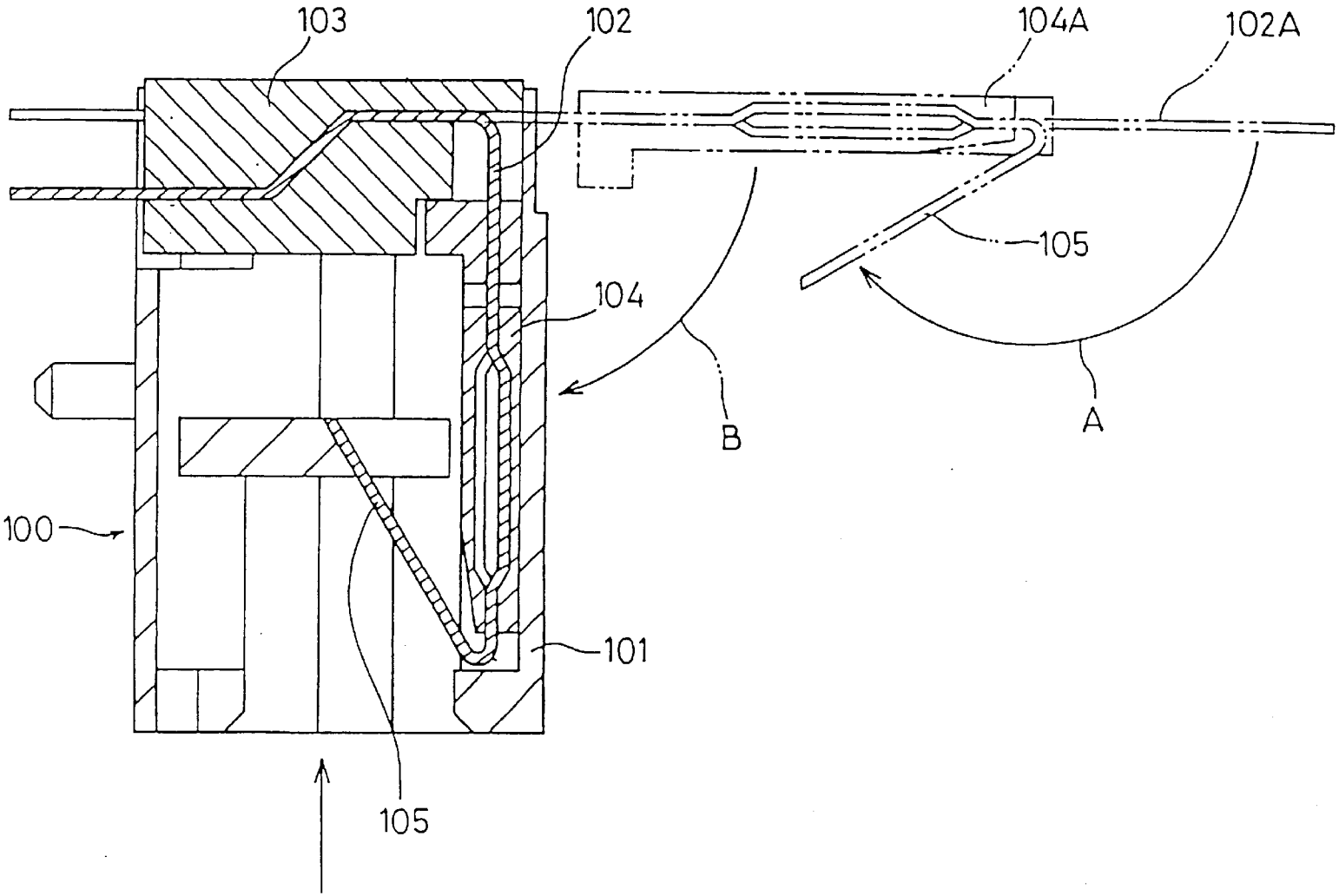
FIG. 9 is a sectional view of a conventional electric connector.

The support wall 62 has teeth 62B and grooves 62C between the teeth 61B. The grooves 62C are tilted to receive the tilted sections of the comb section 52. The front mold 40 is different from that of FIG. 2 in that the ridge 44 forming the end groove 43 has a protruded section 44B. The protruded section 44B has a sloped face 44C which cooperates with the uttermost right-hand tooth 62B to form a groove that is similar to the groove 62C. These molds are assembled in the same manner as in the first embodiment to make molding as shown in FIG. 8.

As has been described above, according to the invention, the terminals made by bending are molded integrally with the housing at once to provide a connector so that it is very easy to make at a low cost. Since the terminals are supported directly by the housing, the terminal retention becomes strong. The precision of molds is so high that the positions of terminals are very precise.

What is claimed is:

1. An electrical connector comprising:

a substantially rectangular housing having upper, rear, side and bottom walls and a receiving cavity defined by said walls and extending rearwardly from a front end of said housing for receiving a mating plug connector; and a plurality of terminals arranged in said housing at regular intervals, each being made by bending a metal pin formed by stamping a metal sheet and having an intermediate section including a first retention portion retained by said upper wall, a second retention portion retained by said rear wall, and a bend provided between said first and second retention portions, said bend and vicinity area thereof being laterally offset by a distance equal to that of said regular intervals, a flexible section bent at an acute angle and rearwardly extending from an end of said first retention portion to flex toward said upper wall for spring contact with a terminal of said plug connector, said flexible section and said first and second retention portions lying in a single plane, and a connection section extending from an end of said second retention portion and projecting from said housing, said terminals being molded integrally with said housing at said first and second retention portions.

* * * * *